US008167594B2

(12) United States Patent
Ni et al.

(10) Patent No.: US 8,167,594 B2
(45) Date of Patent: May 1, 2012

(54) SCROLL COMPRESSOR WITH MATERIALS TO ALLOW RUN-IN

(75) Inventors: Shimao Ni, Bolingbrook, IL (US); Stéphane Watts, Lyons (FR)

(73) Assignee: Scrolllabs Corporation, Bolingbrook, IL (US)

( * ) Notice: Subject to any disclaimer, the term of this patent is extended or adjusted under 35 U.S.C. 154(b) by 554 days.

(21) Appl. No.: 12/364,633

(22) Filed: Feb. 3, 2009

(65) Prior Publication Data

US 2010/0196183 A1 Aug. 5, 2010

(51) Int. Cl.
*F03C 2/00* (2006.01)
*F03C 4/00* (2006.01)
*F04C 18/00* (2006.01)

(52) U.S. Cl. ..... 418/55.5; 418/55.2; 418/57; 418/178

(58) Field of Classification Search ..... 418/55.1–55.6, 418/57, 152, 178–179
See application file for complete search history.

(56) References Cited

U.S. PATENT DOCUMENTS

| | | | | | |
|---|---|---|---|---|---|
| 4,487,560 | A | * | 12/1984 | Uchikawa et al. | 418/55.2 |
| 5,277,563 | A | | 1/1994 | Wen-Jen et al. | |
| 5,458,471 | A | | 10/1995 | Ni | |
| 5,492,460 | A | * | 2/1996 | Takeda et al. | 418/55.2 |
| 5,584,678 | A | * | 12/1996 | Hirooka et al. | 418/55.2 |
| 5,588,820 | A | | 12/1996 | Hill et al. | |
| 5,727,934 | A | * | 3/1998 | Sekita et al. | 418/55.2 |
| 6,174,149 | B1 | | 1/2001 | Bush | |
| 6,368,088 | B1 | | 4/2002 | Hsiao et al. | |
| 6,783,338 | B2 | * | 8/2004 | Moroi et al. | 418/55.2 |
| 6,887,052 | B1 | * | 5/2005 | Bush et al. | 418/55.2 |
| 2003/0000238 | A1 | | 1/2003 | Uchida et al. | |
| 2007/0092390 | A1 | | 4/2007 | Ignatiev | |

FOREIGN PATENT DOCUMENTS

| | | | | | |
|---|---|---|---|---|---|
| DE | 19853240 | A1 | | 5/2000 | |
| EP | 380439 | A2 | | 8/1990 | |
| EP | 1577558 | A2 | | 9/2005 | |
| JP | 02149785 | A | * | 6/1990 | 418/55.2 |
| JP | 05240174 | A | * | 9/1993 | 418/55.2 |
| JP | 2001304149 | A | * | 10/2001 | |

OTHER PUBLICATIONS

International Search Report dated Jul. 21, 2010.

* cited by examiner

*Primary Examiner* — Theresa Trieu
(74) *Attorney, Agent, or Firm* — Carlson, Gaskey & Olds, PC

(57) ABSTRACT

A scroll compressor comprises a non-orbiting scroll member having a base and a generally spiral wrap extending from its base, and an orbiting scroll member having a base and a generally spiral wrap extending from its base. The wraps of the non-orbiting and orbiting scroll members interfit to define compression chambers. A drive shaft causes the orbiting scroll member to orbit relative to the non-orbiting scroll member. At least one of the non-orbiting and orbiting scroll operate to move in an axial direction toward the other of the non-orbiting and orbiting scroll members. The scroll compressor supplies a bias force to bias the at least one scroll member toward the other. A first of the non-orbiting and orbiting scroll members have at least a portion of its surface formed of a material that is harder than the material that it will contact on a second of the non-orbiting and orbiting scroll members, such that upon start-up there will be run-in and removal of the material.

10 Claims, 2 Drawing Sheets

SCROLL COMPRESSOR WITH MATERIALS TO ALLOW RUN-IN

BACKGROUND OF THE INVENTION

This application relates to a scroll compressor, wherein one of the two scroll members is formed of a significantly harder material than the other such that run-in can occur at start-up of the scroll compressor.

Scroll compressors are known, and are becoming widely utilized in fluid compression applications. In a typical scroll compressor, one scroll member has a base and a generally spiral wrap extending from its base. The generally spiral wrap of this scroll member interfits with a generally spiral wrap of a second scroll member. The wraps interfit to define compression chambers. One of the two scroll members is caused to orbit relative to the other, and as the orbiting movement occurs, the size of the compression chambers decrease and an entrapped fluid is compressed.

One challenge with scroll compressor designs is the creation of a separating force between the two scroll members. As the fluid is compressed, the pressure within the compression chambers increases, and tends to force the two scroll members away from each other. To address this, it is typical that a force is applied behind one of the two scroll members tending to bias it toward the other.

Thus, one of the two scroll members is typically capable of some limited axial movement toward the other.

In addition, it is important for there to be tight tolerances, and that the tip of the spiral wrap of one scroll member is close to the base of the opposed scroll member. However, due to tolerances, etc., it is often the case that some of the scroll wrap may be spaced from the opposed base.

Also, the actual shape of a scroll member in operation may change significantly from the machined shape. This can occur due to mechanical stresses, thermal stresses, and the internal pressures.

It is known to form the scroll compressor members of various materials.

SUMMARY OF THE INVENTION

A scroll compressor comprises a non-orbiting scroll member having a base and a generally spiral wrap extending from its base, and an orbiting scroll member having a base and a generally spiral wrap extending from its base. The wraps of the non-orbiting and orbiting scroll members interfit to define compression chambers. A drive shaft causes the orbiting scroll member to orbit relative to the non-orbiting scroll member. At least one of the non-orbiting and orbiting scroll operate to move in an axial direction toward the other of the non-orbiting and orbiting scroll members. The scroll compressor supplies a bias force to bias the at least one scroll member toward the other. A first of the non-orbiting and orbiting scroll members have at least a portion of its surface formed of a material that is harder than the material that it will contact on a second of the non-orbiting and orbiting scroll members, such that upon start-up there will be run-in and removal of the material.

These and other features of the present invention can be best understood from the following specification and drawings, the following of which is a brief description.

DETAILED DESCRIPTION OF THE PREFERRED EMBODIMENT

Figure 1:
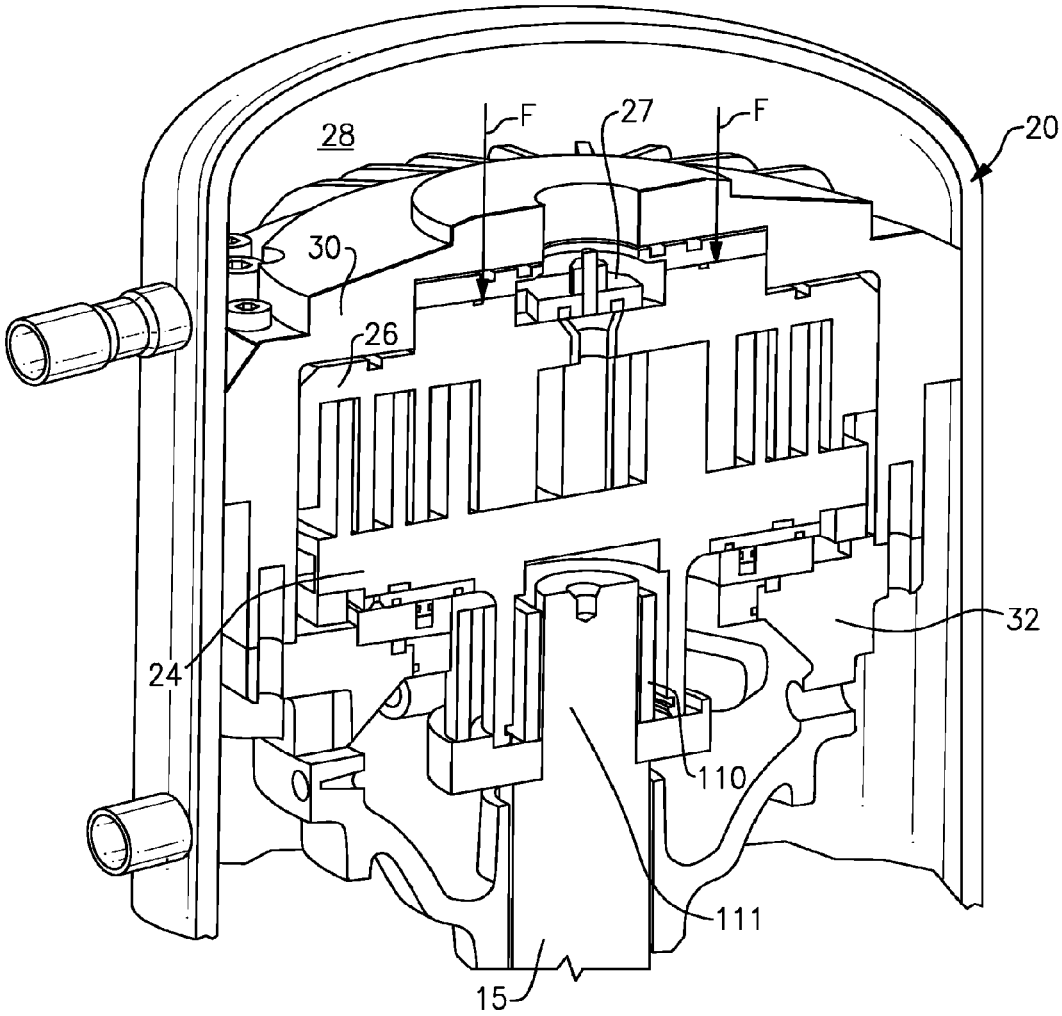
FIG.1 Prior Art
FIG. 1 is a cross-sectional view through a prior art scroll compressor.

FIG. 1 shows a standard scroll compressor 20. As shown, a shaft 15 causes an orbiting scroll member 24 to orbit relative to a non-orbiting scroll member 26. The non-orbiting scroll member in this case receives a force tending to bias it toward the orbiting scroll member 24. This resists the separating force as mentioned above. The force may be from a spring or a tap of compressed or partially compressed fluid. While this application will refer to the scroll wraps as being "generally spiral," it should be understood that this term would extend to so-called "hybrid" wrap scroll compressors wherein the shape of a scroll wrap is a series of connected curves, rather than a pure spiral. Still, all scroll wraps do extend along curves from a central point radially outwardly, and wrapping around each other. The term "generally spiral" as used in this application extends to all such shapes. While the force is shown behind the non-orbiting scroll member 26, it is also known to apply a bias force behind the orbiting scroll member 24, and the teachings of this invention would extend to such a scroll compressor.

A crankcase 32 supports the orbiting scroll 24, and a housing 30 surrounds the non-orbiting scroll 26.

Figure 2A:
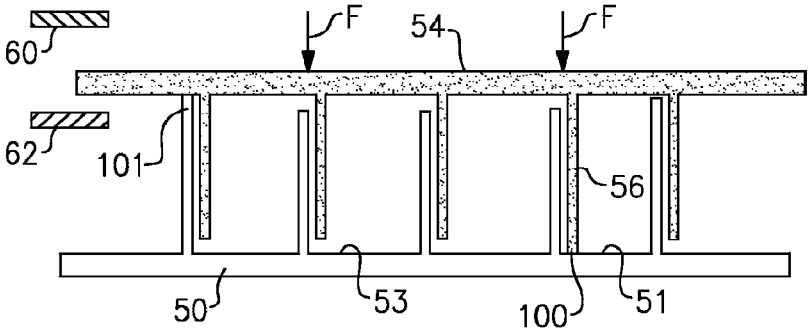
FIG. 2A shows an inventive scroll compressor at start-up.

As shown in FIG. 2A, at start-up, the inventive orbiting scroll member 50 may have its base 53 include some variation such that some portion of the wrap 56 of the non-orbiting scroll 54 are in contact with a portion of the base 50, such as shown near 51, while other portions of the wrap are spaced away from the base 53. This is undesirable.

The amount of the tolerance problem is exaggerated to illustrate the problem.

Another problem that occurs is that since the portions 100 of the wrap 56 that is in contact with area 51 will also tend to force the other portions of the wrap away from the base 50. Thus, as shown in FIG. 2A, there may be gaps, which would be undesirable. In addition, the tip 101 of the orbiting scroll wrap 52 may also wear.

As shown in FIG. 1, the connection between shaft 15 and the orbiting scroll 24 includes a slider block 110, and an eccentric pin 111. Such a drive connection is known, and provides a "radially compliant" scroll set. In a radially compliant scroll set, there is a centrifugal force urging the scroll wraps into contact with each other. However, they may also move out of contact. With the wearing that occurs with the inventive scroll compressor due to its material construction, there may also be run-in adjustment to address tolerances and the actual shape of the scroll compressor components from this radial contact.

The initial clearance between the non-orbiting scroll base 54 and the stop 62 may be set higher than a nominal wrap height tolerance. That is, the scroll compressor wrap may be designed such that the height of the orbiting scroll wraps 52 is selected such that there will be initial clearance until run-in achieves a perfectly tailored shape.

In the inventive scroll compressor, the non-orbiting scroll 54 is formed of a hardened material. This is illustrated by the shading on scroll 54. In one example, 6061 aluminum alloy may be utilized. After the scroll wrap is machined, it is hard anodized treated, and then coated with Teflon to seal surface porosity.

At the same time, the orbiting scroll member 50 is also made of 6061 aluminum alloy, but without any hardening treatment or Teflon treatment.

With this arrangement, at start-up of the scroll compressor, the wrap portion 56 which was in contact with the area 51 will wear into the base, such as shown at 53. With this wearing, there will be a tight tolerance fit across the entire scroll compressor wrap.

In addition, there are stops 60 and 62 that are formed within the scroll compressor, and which serve to limit the axial movement of the non-orbiting scroll 54. The stop 60 is important because a pressure spike could force the non-orbiting scroll member 54 away from the orbiting scroll member 50. Stop 60 will then serve to limit this movement.

Figure 2B:
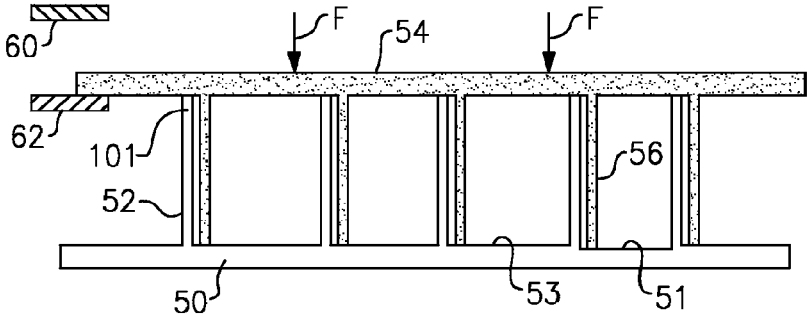
FIG. 2B shows the scroll compressor after a period of operation.

On the other hand, as shown in FIG. 2B, the stop 62 will limit the amount of run-in which can occur.

Figure 3:
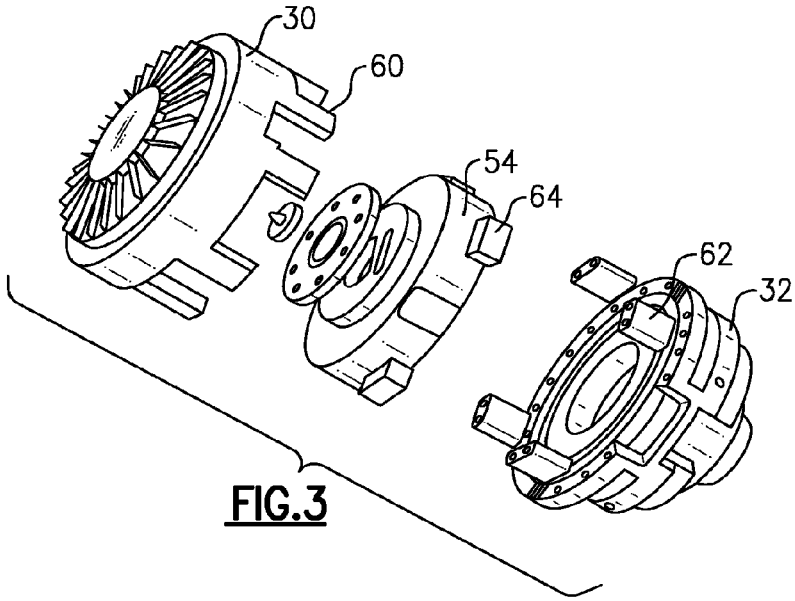
FIG. 3 is an exploded view of the inventive scroll compressor.

As shown in FIG. 3, the stops 62 may be formed on the crankcase 32, and the stop 60 may be formed on the housing member 30. The stops 62 and 60 may be formed integrally with the crankcase 32 and housing member 30, or may be plates which are screwed onto the respective members. As can be appreciated from FIG. 3, the non-orbiting scroll 54 may be formed with gears 64, which actually contacts the stops 60 and 62.

In another option, the height of the wrap of the softer scroll member may be selected to be slightly higher than the wrap of the harder scroll member. This will reduce the duration of the run-in period, and reduce the amount of debris that is generated.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a non-orbiting scroll member having a base and a generally spiral wrap extending from its base;

an orbiting scroll member having a base and a generally spiral wrap extending from its base, said wraps of said non-orbiting and orbiting scroll members interfitting to define compression chambers;

a drive shaft for causing said orbiting scroll member to orbit relative to said non-orbiting scroll member;

at least one of said non-orbiting and orbiting scroll members being operable to move in an axial direction toward the other of said non-orbiting and orbiting scroll members and a bias force to bias said at least one toward the other;

a first of said non-orbiting and orbiting scroll members having at least a portion of its surface formed of a material that is harder than the material that it will contact on a second of said non-orbiting and orbiting scroll members, such that upon start-up there will be run-in and removal of the material;

wherein one of said non-orbiting and said orbiting scroll members being formed of aluminum and provided with a hardening treatment, and the other of said non-orbiting and orbiting scroll members being formed of aluminum but not provided with a hardening treatment;

wherein axial stops limit the axial movement of said at least one of said orbiting and non-orbiting scroll members; and wherein said non-orbiting scroll is allowed to move axially and contact said stops.

2. The scroll compressor as set forth in claim 1, wherein said non-orbiting scroll member is caused to move axially toward said orbiting scroll member.

3. The scroll compressor as set forth in claim 1, wherein said non-orbiting scroll member is provided with said hardening treatment.

4. The scroll compressor as set forth in claim 3, wherein a Teflon coating is formed on said at least a portion of said non-orbiting scroll.

5. A scroll compressor comprising:

a non-orbiting scroll member having a base and a generally spiral wrap extending from its base;

an orbiting scroll member having a base and a generally spiral wrap extending from its base, said wraps of said non-orbiting and orbiting scroll members interfitting to define compression chambers;

a drive shaft for causing said orbiting scroll member to orbit relative to said non-orbiting scroll member;

at least one of said non-orbiting and orbiting scroll members being operable to move in an axial direction toward the other of said non-orbiting and orbiting scroll members and a bias force to bias said at least one toward the other;

a first of said non-orbiting and orbiting scroll members having at least a portion of its surface formed of a material that is harder than the material that it will contact on a second of said non-orbiting and orbiting scroll members, such that upon start-up there will be run-in and removal of the material;

axial stops limit the axial movement of said at least one of said orbiting and non-orbiting scroll members; and wherein a height of said second of said non-orbiting and orbiting scroll wraps is selected such that said orbiting and non-orbiting scroll members are initially in contact with each other, with said axial stops not limiting axial movement until run-in occurs.

6. The scroll compressor as set forth in claim 1, wherein a drive connection between said drive shaft and said orbiting scroll member is such that the connection is radially compliant, and wherein run-in and removal of material also occurs between said orbiting and non-orbiting scroll members in a radial direction.

7. A scroll compressor comprising:

a non-orbiting scroll member having a base and a generally spiral wrap extending from its base;

an orbiting scroll member having a base and a generally spiral wrap extending from its base, said wraps of said non-orbiting and orbiting scroll members interfitting to define compression chambers;

a drive shaft for causing said orbiting scroll member to orbit relative to said non-orbiting scroll member;

said non-orbiting scroll members being operable to move in an axial direction toward said orbiting scroll member and said scroll compressor supplying a bias force to bias said non-orbiting scroll member toward said orbiting scroll member;

said non-orbiting scroll member having at least a portion of its surface formed of a material that is harder than the material that it will contact on said orbiting scroll member, such that upon start-up there will be run-in and removal of the material;

said non-orbiting scroll member is provided with a hardening treatment, and a Teflon coating;

axial stops limit the axial movement of said orbiting and non-orbiting scroll member, in two axial directions; and wherein a height of said non-orbiting and orbiting scroll wraps is selected such that said orbiting and non-orbiting scroll members are initially in contact with each other, with said axial stops not limiting axial movement until run-in occurs.

8. The scroll compressor as set forth in claim 7, wherein each of said non-orbiting and orbiting scroll members are formed of an aluminum material.

9. The scroll compressor as set forth in claim 7, wherein a drive connection between said drive shaft and said orbiting scroll member is such that the connection is radially compliant, and wherein run-in and removal of material also occurs between said orbiting and non-orbiting scroll members in a radial direction.

10. A scroll compressor comprising:

a non-orbiting scroll member having a base and a generally spiral wrap extending from its base;

an orbiting scroll member having a base and a generally spiral wrap extending from its base, said wraps of said non-orbiting and orbiting scroll members interfitting to define compression chambers;

a drive shaft for causing said orbiting scroll member to orbit relative to said non-orbiting scroll member;

at least one of said non-orbiting and orbiting scroll members being operable to move in an axial direction toward the other of said non-orbiting and orbiting scroll members and a bias force to bias said at least one toward the other;

a first of said non-orbiting and orbiting scroll members having at least a portion of its surface formed of a material that is harder than the material that it will contact on a second of said non-orbiting and orbiting scroll members, such that upon start-up there will be run-in and removal of the material;

wherein a height of said generally spiral wrap of said first of said non-orbiting and orbiting scroll members being shorter than a height of said generally spiral wrap of said second of said non-orbiting and orbiting scroll members;

wherein one of said non-orbiting and said orbiting scroll members being formed of aluminum and provided with a hardening treatment, and the other of said non-orbiting and orbiting scroll members being formed of aluminum but not provided with a hardening treatment; and said non-orbiting scroll is allowed to move axially relative to said orbiting scroll, and axial stops limiting the axial movement of said non-orbiting scroll member;

wherein a height of said other of said non-orbiting and orbiting scroll wraps is selected such that said orbiting and non-orbiting scroll members are initially in contact with each other, with said axial stops not limiting axial movement until run-in occurs.

* * * * *